United States Patent [19]

Enkner et al.

[11] 4,280,688

[45] Jul. 28, 1981

[54] TILTABLE CONVERTER ARRANGEMENT

[75] Inventors: Bernhard Enkner; Rupert Berger; Manfred Eysn, all of Linz; Hermann Haslehner, Alkoven; Helmut Smejkal, Linz; Michael Sattler, Ansfelden, all of Austria

[73] Assignee: Voest-Alpine Aktiengesellschaft, Linz, Austria

[21] Appl. No.: 89,526

[22] Filed: Oct. 30, 1979

[30] Foreign Application Priority Data

Nov. 10, 1978 [AT] Austria ..... 8050/78

[51] Int. Cl.[3] ..... C21C 5/50

[52] U.S. Cl. ..... 266/245; 266/246

[58] Field of Search ..... 75/60; 266/245, 246

[56] References Cited

U.S. PATENT DOCUMENTS

| | | | |
|---|---|---|---|
| 3,312,544 | 4/1967 | McCready | 75/60 |
| 3,391,919 | 7/1968 | Eberhart | 266/246 |
| 3,400,922 | 9/1968 | Langlitz | 266/246 |
| 3,548,678 | 12/1970 | Phillips | 266/245 |
| 3,784,178 | 1/1974 | Wernli | 266/245 |

*Primary Examiner*—P. D. Rosenberg

*Attorney, Agent, or Firm*—Brumbaugh, Graves, Donohue & Raymond

[57] ABSTRACT

A tiltable converter vessel is supported on a carrying body arranged about its shell by means of lug pairs accommodating bearing forces, the lugs of each lug pair being arranged opposite each other on both sides of the carrying body. At least one lug of each lug pair is supported on the carrying body by at least one piston-cylinder unit whose piston is hydraulically adjustable in the longitudinal direction of the converter vessel. At least one further piston-cylinder unit is arranged parallel to the extension of the carrying ring.

8 Claims, 7 Drawing Figures

TILTABLE CONVERTER ARRANGEMENT

BACKGROUND OF THE INVENTION

The invention relates to a tiltable converter whose converter vessel is supported by means of lug pairs accommodating bearing forces and positioned on a carrying body arranged about its shell, the lugs of one lug pair being arranged to lie opposite each other on both sides of the carrying body.

It has been known to adjust the lugs that are arranged on both sides of the carrying body via shims, when mounting the converter vessel, such that the converter is held without play relative to the carrying ring even if the converter is tilted upside down, i.e. by 180°. This mode of construction, however, which has proved successful in particular with big converters, has the disadvantage that in the course of a converter campaign, uneven thermal expansions cause the expansion of the shell of the vessel more than the carrying ring. As a result a play can form between the lugs and the carrying ring despite the shims, thus causing impacts between the vessel and the ring when the converter is tilted.

Various measures have been proposed in order to avoid the play that forms during a converter campaign. Theoretically, this can be achieved (U.S. Pat. No. 3,191,921) by providing the lugs with wedges whose oblique planes each rest on a corresponding oblique plane of a wedge that is supported on the carrying ring, the inclination of the oblique planes being chosen in accordance with the expected theoretical radial and axial expansions of the vessel. This solution, however, has not entered into practice, in particular with big converters, where an absolute lack of play is essential, since the ideal inclination angle of the wedges can be determined only in theory. A practical calculation of the angle is prevented because the converter vessel carries out movements relative to the carrying ring that cannot be exactly predetermined, due to thermal and mechanical influences.

For eliminating the play it has further been known (Austrian Pat. application No. A 8559/70) to mount the wedges arranged on the lower side of the carrying ring in a displaceable manner, spring packets being provided as displacement means. If the wedge angle in this case is larger than the angle of friction, the springs have to be dimensioned so strong that they will be capable of keeping the converter vessel in position when it is upside down. Consequently great additional forces act on the converter vessel and the carrying ring in the 0°-position of the converter, i.e. in its upright position.

SUMMARY OF THE INVENTION

The invention aims at avoiding these disadvantages and difficulties and has as its object to provide a converter, in particular a big converter, in which the unavoidable play between the carrying lugs and the carrying ring may be of any extent, but does not cause any impacts during tilting of the converter, and wherein no forces will be caused by the construction of the suspension of the converter vessel in the carrying ring which would additionally strain the converter vessel or the carrying ring.

This object of the invention is achieved in that at least one lug of each pair of lugs is supported on the carrying body by means of at least one piston-cylinder unit whose piston is hydraulically displaceable in the longitudinal direction of the converter vessel.

According to a preferred embodiment, at least one lug of a pair of lugs comprises, in addition to the piston-cylinder units provided in the longitudinal direction of the converter vessel, supporting faces that extend parallel to the longitudinal direction of the converter vessel. These faces are each supported on counter supporting faces arranged on the carrying body. At least one supporting face or counter supporting face is formed by a piston of a piston-cylinder unit which is hydraulically actuatable and which is arranged parallel to the extension of the carrying body.

A suitable configuration of the invention is characterized in that the cylinder of the piston-cylinder unit is connected with an equalizing reservoir via a hydraulic conduit into which a check valve is inserted. This valve can be switched selectively into and out of operation such that when it is in operation it makes possible the flow of hydraulic medium only in the direction from the equalizing reservoir to the cylinder, and when it is out of operation, it releases the hydraulic conduit for flow in both directions. A pulse generator preferably is provided for the switching of the check valve, with which generator the check valve is switchable out of operation when the converter is in the upright position and into operation at the onset of tilting of the converter.

A further advantageous embodiment of the invention is characterized in that both lugs of each pair of lugs are supported on the carrying body by means of at least one hydraulically actuatable piston-cylinder unit, the cylinder of each piston-cylinder unit being connected to an equalizing reservoir via a hydraulic conduit in which a throttle valve is installed.

This construction can be utilized also for supporting the supporting faces and the counter supporting faces which extend parallel to the longitudinal direction of the converter vessel. As a result both supporting faces or counter supporting faces are each formed by a piston of a piston-cylinder unit and the cylinder of each piston-cylinder unit is connected to an equalizing reservoir via a hydraulic conduit into which a throttle valve is installed.

For continuously supplying sufficient hydraulic medium to the piston-cylinder units, a spring-actuated displacement piston is provided in the equalizing reservoir.

BRIEF DESCRIPTION OF THE DRAWINGS

The invention will now be explained in more detail by way of several embodiments and with reference to the accompanying drawings, wherein.

DESCRIPTION OF ILLUSTRATIVE EMBODIMENTS

Figure 1:
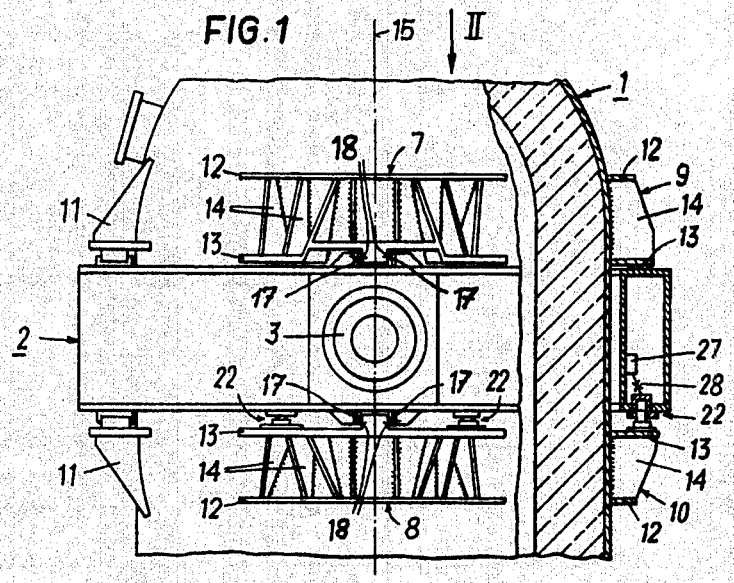
FIG. 1 is a partially sectioned side view of a converter in the direction of the carrying trunnion axis.
Figure 2:
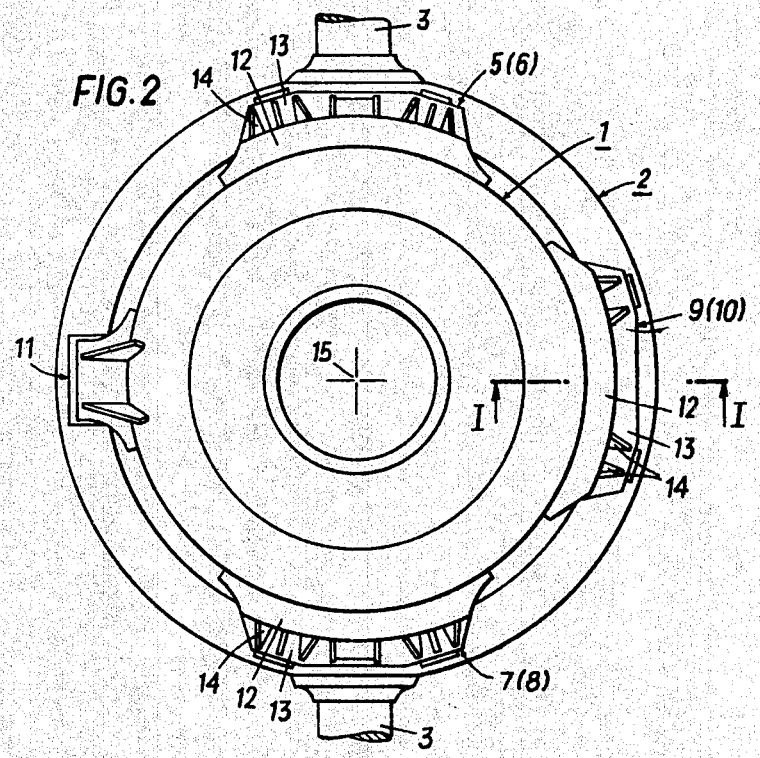
FIG. 2 is a view in the direction of the arrow II of FIG. 1.

A converter vessel 1 is surrounded by a carrying body 2 which is designed as a closed carrying ring. The carrying ring 2 is tiltably mounted in support bearings (not illustrated) by means of two aligning carrying trunnions 3.

The converter vessel 1 is suspended in the carrying ring 2 by means of two pairs of carrying lugs 5, 6 and 7, 8, respectively, which are arranged at the carrying trunnions 3. In a plane perpendicular to the carrying trunnions 3, a further pair of lugs 9, 10—the tilting lug pair—is arranged. These three pairs of lugs suitably are designed to be equal to one another. For constructional reasons, they are each designed as a double-lug pair.

Diametrically opposite the tilting lug pair 9, 10 there are arranged guiding means 11 which are designed in a known manner merely for accommodating lateral forces and do not rest upon the carrying ring 2.

Each of the lugs 5 to 10 is formed by upper and lower chords 12, 13 welded to the converter vessel, and ribs 14 located therebetween and also welded to the converter vessel. Each lower chord 13 of the lugs comprises two resting faces 16 that transmit forces occurring in the longitudinal direction 15 of the converter vessel, and two supporting faces 17 extending between these resting faces parallel to the longitudinal direction 15 of the converter vessel. The supporting faces 17 transmit forces that are directed in the peripheral direction of the carrying ring 2 to counter supporting faces 18 which are fastened to the carrying ring 2.

The distance 19 between the oppositely arranged resting faces 16 of one pair of lugs is chosen to be larger than the height 20 of the carrying ring 2 located between them. For overcoming the play resulting therefrom, piston-cylinder units 22 are mounted on the lower side 21 of the carrying ring according to the embodiment of FIGS. 1 to 4. The axes 23 of these units are arranged approximately parallel to the longitudinal direction 15 of the converter 1. The cylinder 24 of each piston-cylinder unit 22 is inserted in the lower-side chord 25 of the carrying ring 2 and, by means of a hydraulic conduit 26, is in connection with an equalizing reservoir 27 that is arranged within the carrying ring. In the hydraulic conduit, a check valve 28 is installed which can selectively be set into operation or out of operation by means of a pulse generator (not illustrated). The check valve, when in operation, makes possible the flow of hydraulic medium only in the direction from the equalizing reservoir 27 in the cylinder 24 and, when out of operation, releases the hydraulic conduit 26 for flow in both directions. In each equalizing reservoir 27 there is a displacement piston 29 which is actuated by a spring, so that the hydraulic medium is constantly urged in the direction towards the piston-cylinder unit 22.

The arrangement functions in the following manner: At first, when in the upright position (0°-position), the converter rests on the carrying ring 2 only with lugs 5, 7, 9 that are arranged above the converter ring 2. By means of the displacement pistons 29, hydraulic medium is pressed into the cylinders 24, whereby the pistons 30 of the piston-cylinder units 22 are pressed outwards until they contact the resting faces 16 of the flus 6, 8, 10 that are arranged on the lower side 21 of the carrying ring 2. A backward urging of the pistons 30 is prevented by the check valves 28 when they are switched into operation. Since, during one converter campaign, the converter vessel 1 gets hotter and hotter, enlargements of the distances 19 of the oppositely arranged resting faces 16 of the lug pairs 5, 6; 7, 8 and 9, 10, caused by thermal expansions of the vessel. These enlargements are balanced out by the subsequent flow of hydraulic medium into the cylinders 24 and the further forward movement of the pistons 30 caused thereby. In order to allow for reductions between the distances of the oppositely arranged resting faces 16 of the lug pairs—such as for example the reduction that takes place to a great extent at the end of a converter campaign when the converter vessel is cooling off—the check valves 28 are switched out of operation if the converter is in the 0°-position. Suitably, the check valves 28 are switched into operation only during tilting and are switched out of operation only after termination of tilting (in the 0°-position of the converter), so that impacts and shocks of the vessel against its carrying ring will not occur during tilting. Since the tilting process is of a relatively short duration, no constraining forces between the lug pairs 5, 6; 7, 8 and 9, 10 and the carrying ring 2 will occur during tilt. Between the tilting processes the converter and the carrying ring can deform to any degree, since the hydraulic medium, with the check valves 28 switched out of operation, can flow in both directions, to and from the cylinders 24.

Figure 3:
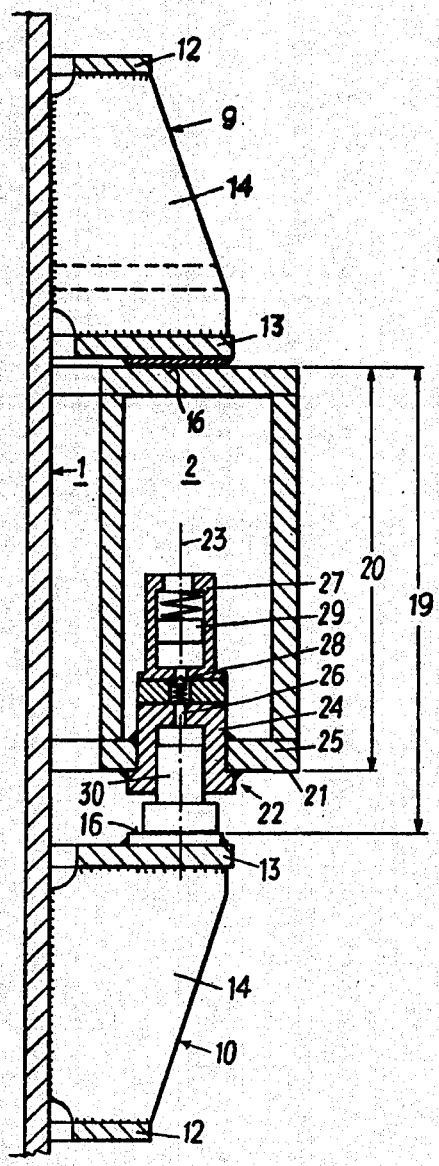
FIG. 3 is a detail of FIG. 1 on an enlarged scale.
Figure 4:
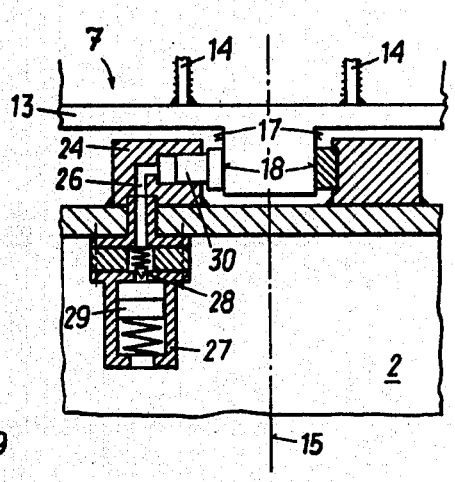
FIG. 4 illustrates the application of the embodiment illustrated in FIGS. 1 to 3 to support of supporting faces extending parallel to the longitudinal direction of the converter vessel.

In FIG. 4 the application of the principle represented in FIG. 3 is illustrated for the supporting faces 17 which extend parallel to the longitudinal direction of the converter vessel. In FIG. 4 corresponding parts are denoted by the same reference numerals used in FIG. 3. For the supporting faces 17 that extend in the longitudinal direction of the converter vessel the construction shown in FIG. 4 is not necessarily required, since the distance of the supporting faces at each lug 5 to 10 is relatively small, and expansions and deformations occur only to a considerably slighter degree than in case of the resting faces 16. It is also possible to support also the guiding means 11 laterally against the carrying ring as illustrated in FIG. 4.

Figure 5:
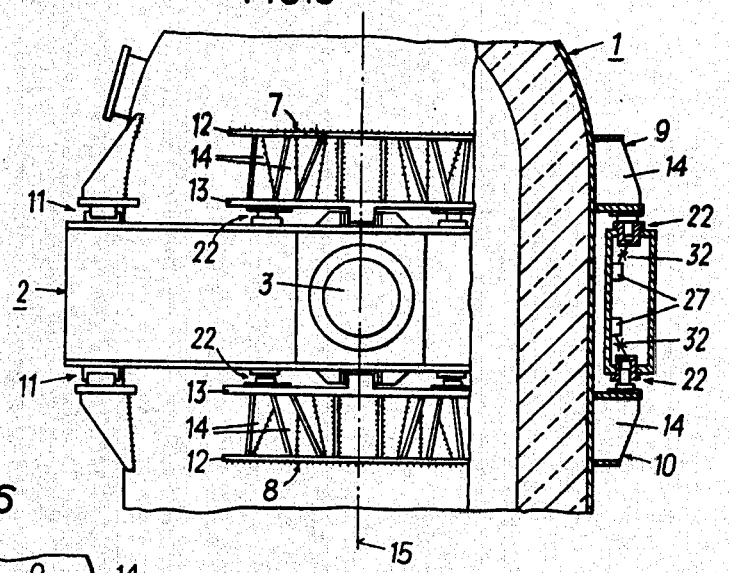
FIGS. 5 to 7 show a further embodiment, FIG. 5 illustrating a converter in a representation analogous to FIG. 1, FIG. 6 being a detail of FIG. 5 on an enlarged scale, and FIG. 7 illustrating the application of the embodiment represented in FIGS. 5 and 6 to the supporting faces extending parallel to the longitudinal direction of the converter vessel.
Figure 6:
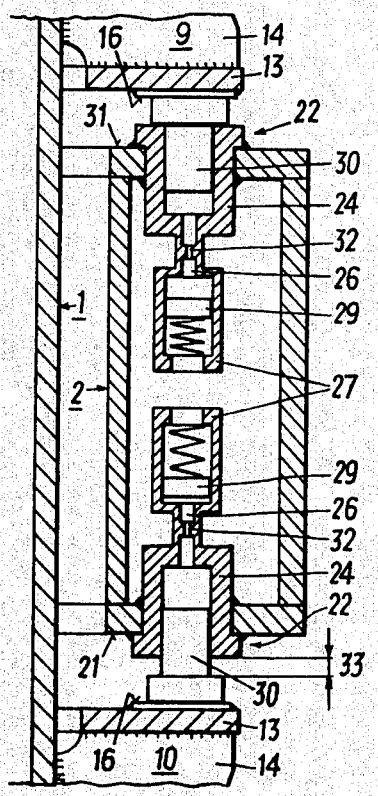
Figure 7:
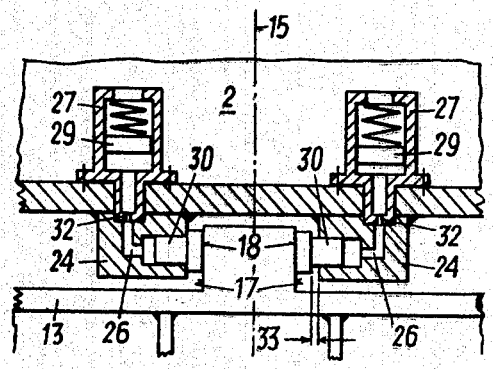

With the embodiment illustrated in FIGS. 5 to 7, piston-cylinder units 22 are arranged at each pair of lugs 5, 6; 7, 8 and 9, 10 both on the upper side 31 and on the lower side 21 of the converter carrying ring 2. Each cylinder 24 of the piston-cylinder units 22 is connected via a hydraulic conduit 26 with an equalizing reservoir 27, in which a spring-actuated displacement piston 29 is installed. In each of the hydraulic conduits 26, a throttle valve 32 is installed.

The performance of this arrangement is in the following manner: By the weight of the converter, when the latter is in the upright position, the hydraulic medium is pressed into the respective equalizing reservoir 27 for all piston-cylinder units 22 arranged on the upper side 31 of the carrying ring 2. For the piston-cylinder units 22 arranged on the lower side 21 of the carrying ring, each piston 30 is constantly pressed against the appropriate resting face 16 of the lower lug pairs 6, 8 and 10, due to the spring-actuated displacement piston 29 within the equalizing reservoir 27. If the converter is tilted, the throttle valves 32 of the piston-cylinder units arranged on the lower side 21 of the carrying ring—which during tilting come to lie above the carrying ring 2—at first act like a blockage of the hydraulic conduit 26, so that the converter vessel 1 at first cannot move relative to the carrying ring 2. However, the hydraulic medium subsequently is slowly pressed into the equalizing reservoirs 27 due to the weight of the converter vessel, so that the converter vessel 1 will be lowered in accordance with the moving play 33 of the pistons 30 relative to the carrying ring 2. The piston-cylinder units 22, which are directed downwards during tilting of the converter, balance out the play between the carrying ring 2 and the converter vessel 1 during that period of time by lowering of their pistons 30 (due to the relief of the converter vessel weight therefrom and the spring-actuated displacement pistons 29). Therefore, no impacts will ever occur, and also deformations occurring at the converter vessel, as well as at the carrying ring, do not result in any additional load for the suspension.

In FIG. 7 the application of the arrangement according to FIG. 6 is shown for the supporting faces 17 which extend parallel to the longitudinal direction 15 of the converter vessel 1, corresponding parts again being denoted by the same reference numerals. This arrangement, shown in FIG. 7, can also be applied to the guiding means 11.

In the case of big converters, it may be necessary to provide several piston-cylinder units 22 at each resting face of the lugs 5 to 10. Then it is possible to connect the adjacent piston-cylinder units to the same equalizing reservoir and to provide a single check valve or a single throttle valve, respectively, for the adjacently arranged piston-cylinder units. In principle, it is also possible to install the piston-cylinder unit in the lugs.

What we claim is:

1. In a tiltable converter arrangement of the type including a converter vessel having a converter shell, a hollow carrying body arranged about said converter shell, lug pairs accommodating bearing forces for supporting said converter vessel on said carrying body, each of said lug pairs including two lugs arranged opposite each other on both sides of said carrying body, and at least one hydraulically actuatable piston-cylinder unit provided between one lug of each of said lug pairs and said hollow carrying body and including a piston and a cylinder, said piston being hydraulically adjustable in the longitudinal direction of said converter vessel, the improvement comprising an equalizing reservoir containing a hydraulic medium and provided within said carrying body, a hydraulic conduit for connecting said cylinder of said at least one piston-cylinder unit with said equalizing reservoir, and a check valve installed in said hydraulic conduit and selectively switchable into and out of operation, said check valve, when switched into operation, enabling the flow of said hydraulic medium only in the direction from said equalizing reservoir to said cylinder, and when switched out of operation, releasing said hydraulic conduit for flow in both directions.

2. A tiltable converter arrangement as set forth in claims 1, 3 or 6 further comprising, supporting faces provided on at least one lug of a lug pair and extending parallel to the longitudinal direction of the converter vessel, and counter supporting faces provided on said hollow carrying body for supporting said supporting faces, at least one supporting face or counter supporting face being formed by a piston of an additional hydraulically actuatable piston-cylinder unit arranged parallel to the extension of said carrying body.

3. A tiltable converter arrangement as set forth in claim 1, further comprising a pulse generator provided for switching said check valve out of operation with said converter vessel being in the upright position, and into operation at the onset of tilting of said converter vessel.

4. A tiltable converter arrangement as set forth in claim 1 or 3 wherein both said supporting faces or counter supporting faces are each formed by a piston of a piston-cylinder unit, an equalizing reservoir being provided for the cylinder of each piston-cylinder unit, and further including a hydraulic conduit for connecting said equalizing reservoir with said cylinder, a throttle valve being installed in said hydraulic conduit.

5. A tiltable converter arrangement as set forth in claim 1 or 3, further comprising a spring-actuated displacement piston provided in said equalizing reservoir.

6. In a tiltable converter arrangement of the type including a converter vessel having a converter shell, a hollow carrying body arranged about said converter shell, lug pairs accommodating bearing forces for supporting said converter vessel on said carrying body, each of said lug pairs including two lugs arranged opposite each other on either side of said carrying body, and hydraulically actuatable piston-cylinder units provided between each of said two lugs of said lug pairs and said hollow carrying body and including a piston and a cylinder, said piston being hydraulically adjustable in the longitudinal direction of said converter vessel, the improvement comprising an equalizing reservoir containing a hydraulic medium and provided within said carrying body, a hydraulic conduit for connecting said cylinder of each of said piston-cylinder units with said equalizing reservoir, and a throttle valve installed in said hydraulic conduit for controlling the flow of hydraulic medium between said reservoir and cylinders.

7. A tiltable converter arrangement as set forth in claim 1, 3 or 6, further comprising a spring-actuated displacement piston provided in said equalizing reservoir, supporting faces provided on at least one lug of a lug pair and extending parallel to the longitudinal direction of the converter vessel, and counter supporting faces provided on said hollow carrying body for supporting said supporting faces, at least one supporting face or counter supporting face being formed by a picton of an additional hydraulically actuatable piston-cylinder unit arranged parallel to the extension of said carrying body.

8. A tiltable converter arrangement as set forth in claim 1, 3 or 6, further comprising a spring-actuated displacement piston provided in said equalizing reservoir, supporting faces provided on at least one lug of a lug pair and extending parallel to the longitudinal direction of the converter vessel, and counter supporting faces provided on said hollow carrying body for supporting said supporting faces, and wherein both said supporting faces or counter supporting faces are each formed by a piston of an additional piston-cylinder unit, an additional equalizing reservoir being provided for the cylinder of each additional piston-cylinder unit, and further including an additional hydraulic conduit for connecting said additional equalizing reservoir with said cylinder, an additional throttle valve being installed in said additional hydraulic conduit.

* * * * *

UNITED STATES PATENT AND TRADEMARK OFFICE

CERTIFICATE OF CORRECTION

PATENT NO. : 4,280,688

DATED : July 28, 1981

INVENTOR(S) : Enkner et al.

It is certified that error appears in the above—identified patent and that said Letters Patent is hereby corrected as shown below:

Col. 6, line 8, "claim 1 or 3" should read --claims 1, 3 or 6--.

Col. 6, line 16, "claim 1 or 3" should read --claims 1, 3 or 6--.

Col. 6, lines 45-46, "picton" should read --piston--.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*